US005304969A

United States Patent [19]

Jacobowitz et al.

[11] Patent Number: 5,304,969

[45] Date of Patent: Apr. 19, 1994

[54] APPARATUS AND A METHOD FOR AN ELECTRICAL TRANSMISSION-LINE INTERFACE

[75] Inventors: Lawrence Jacobowitz; Mario E. Ecker, both of Poughkeepsie, N.Y.

[73] Assignee: International Business Machines Corporation, Armonk, N.Y.

[21] Appl. No.: 951,741

[22] Filed: Sep. 25, 1992

Related U.S. Application Data

[63] Continuation of Ser. No. 693,971, Apr. 29, 1991, Pat. No. 5,173,668.

[51] Int. Cl.[5] ..... H01P 1/00; H01P 3/06

[52] U.S. Cl. ..... 333/260; 333/243; 439/63; 439/581

[58] Field of Search ..... 333/245, 246, 247, 24 R, 333/81 A, 81 R, 260, 238, 156, 160, 164, 33, 34, 99 R, 243; 439/63, 578-585, 876; 361/399; 165/80.4

[56] References Cited

U.S. PATENT DOCUMENTS

| | | | |
|---|---|---|---|
| 4,226,281 | 10/1980 | Chu | 165/185 X |
| 4,724,409 | 2/1988 | Lehman | 333/260 |
| 4,771,294 | 9/1988 | Wasilousky | 333/260 X |
| 4,984,990 | 1/1991 | Lindahi | 439/63 |
| 5,173,668 | 12/1992 | Jacobowitz et al. | 333/156 |

FOREIGN PATENT DOCUMENTS

| | | |
|---|---|---|
| 0347398 | 5/1989 | European Pat. Off. . |
| 3436635 | 10/1984 | Fed. Rep. of Germany . |
| 1175259 | 12/1969 | United Kingdom . |
| 2193848 | 6/1987 | United Kingdom . |

OTHER PUBLICATIONS

IBM Technical Disclosure Bulletin 31 (1988) Jun., No. 1, vol. 31, "Delay Line on Ceramic".

*Primary Examiner*—Robert J. Pascal
*Assistant Examiner*—Ali Neyzari
*Attorney, Agent, or Firm*—Aziz M. Ahsan

[57] ABSTRACT

A new interface and a method for making the same, and more particularly, an electrical transmission-line interface and a method for making the same. On a substrate having semiconductors, a driver or receiver circuit is provided to interface with an electrical transmission-line. Integral means for the electrical transmission-line alignment, support and transit through a sealed environment is also provided. A fluid tight seal can also be provided for the various components that are in the interior of the housing. Variable time-delay means is provided for a computer clock system or other microwave applications.

54 Claims, 7 Drawing Sheets

APPARATUS AND A METHOD FOR AN ELECTRICAL TRANSMISSION-LINE INTERFACE

This is a continuation of U.S. patent application Ser. No. 07/693,971, filed on Apr. 29, 1991, now U.S. Pat. No. 5,173,668.

FIELD OF THE INVENTION

The present invention relates generally to a new interface and a method for making the same, and more particularly, to an electrical transmission-line interface and a method for making the same. On a substrate having semiconductors, a driver or receiver circuit is provided to interface with an electrical transmission-line. Integral means for the electrical transmission-line alignment, support and transmit through a sealed environment is also provided. A fluid tight seal can also be provided for the various components that are in the interior of the housing. Variable time-delay means is provided for computer clock system or other microwave applications.

CROSS-REFERENCE

This Patent Application is related to U.S. patent application Ser. No. 07/693,996, now U.S. Pat. No. 5,155,786, entitled "An Apparatus And A Method For An Optical Fiber Interface", which was filed concurrently on Apr. 29, 1991, and which is assigned to the same assignee as this Patent Application, and the disclosure of which is incorporated herein by reference.

BACKGROUND OF THE INVENTION

Interconnection for computer communication applications such as clock distribution, memory and interprocessor data bus, matrix or cross-point switches are key elements in system architecture, package design, function, and performance. Arrays of transmission-lines into fluid-sealed semiconductor chip packages further pose problems in strain-relief at device interfaces, fan-out distribution, integrability, and spatial efficiency. Some of these known problems have been resolved by this invention.

Dense pin-in-hole electrical connectors for today's multichip module (MCM) packaging generates electromagnetic inductance and coupled noise. Furthermore, as the electrical signal passes from the I/O pin to the surface of the MLC substrate, the Delta-i noise induced within multilayer ceramic substrates by semiconductor chips, simultaneously switching logic levels further degrades the electrical signals. In general, these problems of noise and dispersion increase directly with increasing signal frequency, particularly above 100 megahertz.

The distribution of a master oscillator or a system clock to the multichip array on the substrate requires controlled, adjusted time-delay offsets to guarantee simultaneous clock signal arrivals. Departures from simultaneity are known as "skew," and, translate directly into computer cycle-time performance.

This invention addresses these concerns and provides means for resolving some of the issues. For example, it was found that direct connection to the substrate interface minimizes connector and substrate noise. Therefore, the preferred connection for high frequency operation is a cable-TCM interface, where the connection penetrates the side of the TCM (Thermal Conduction Module) and where a receiver is provided at the substrate surface. Strain-relief of the relatively rigid coaxial cable and provision for fluid sealing of the cable-module interface are also addressed in this invention.

The requirement to compensate for clock arrival time differences related to propagation times for nets of different lengths has also been addressed by this invention. The designed delays that are deliberately introduced between ICE's (Interface Control Element), SCE's (System Control Element), etc. within and between printed circuit (PC) boards of thermal conduction modules (TCM) are similarly accommodated by this invention.

Some of the important features of this invention are:

(1) the transmission-line to the module interface,
(2) transmission-line substrate interface,
(3) variable delay-line embodiments,
(4) transmission-line guide, support, fluid seal and strain-relief means, and
(5) separability of the upper and lower module half-planes for repair, test, or engineering change.

Problems in strain-relief at device interfaces, fan-out distribution, integrability, and spatial efficiency are some of the other problems that one has to contend with. Some of these known problems have been resolved by this invention.

The present invention teaches compatible designs for interfacing external transmission-lines into a fluid-sealed, temperature-controlled module, and, direct distribution within the module to selectable semiconductor chip positions. The present invention further teaches direct surface connection of the transmission-line to the substrate surface, and thus avoids the passage of the electrical signal through the module layers or cooling structures.

This invention also allows the presence of C-4s and the semiconductor chips on the substrate while providing unique means for electrical interconnection of the transmission-line to a receiver on the substrate surface. Means for suitably bonding the transmission-line or the signal conductor to a via in the substrate is also provided.

Another, unique feature of this invention are the bellows for the transmission-line which provide, fluid sealing and strain-relief for the connection of the transmission-line at the substrate surface.

OBJECTS AND SUMMARY OF THE INVENTION

An object of this invention is to provide one or more transmission-line interfaces into a multichip module, or, TCM.

Another object of this invention is to remove a decoupling capacitor and utilize its space for direct attachment of the transmission-line or provide a separable connector to the substrate.

Another object of this invention is to provide means in a TCM to guide and align the transmission-line to the point of connection.

Still another object of this invention is to provide means for strain-relief to the transmission-line connections.

Still another object of this invention is to communicate with semiconductor chips on a multilayered substrate using a transmission-line through a TCM.

Still another object of this invention is to provide a fluid tight seal to the assembled substrate.

Yet another object of this invention provides for separability in the transmission-line path for repairs or test.

Still another object of this invention is to have the substrate with the chip and a part of the transmission-line connector secured to a portion of the TCM, so that individual portions of the TCM can be independently separated for repairs, test, or upgrade.

Yet another object of this invention is to maintain compatibility with the TCM elements.

Still yet another object of this invention is to provide means for:

a) penetrating the controlled environment of the TCM (Thermal Conduction Module) with one or more coaxial cables;
b) aligning and securing the coaxial cable through a guide groove;
c) locating and aligning the coaxial cable ends to receiver, driver, or both;
d) mounting of receiver and/or driver devices on the substrate of the TCM;
e) effecting a separable interface between the coaxial cable and the receiver or driver circuits, and
f) providing integral variable time-delay means.

One aspect of this invention discloses an apparatus for an electrical transmission-line interface comprising:

a) a substrate,
b) at least one electrical contact pair in contact with at least one surface of the substrate,
c) at least a portion of at least one transmission-line electrically communicating with the at least one electrical contact pair,
d) a housing protecting the at least one electrical contact pair and the substrate, and,
e) means in the housing for communicating an electrical signal through the housing to the electrical contact pair from the at least one transmission-line.

In another aspect this invention discloses an apparatus for an electrical transmission-line interface comprising:

a) a substrate,
b) at least one electrical contact pair in contact with at least one surface of the substrate,
c) at least one electrical transmission-line,
d) means for guiding the at least one electrical transmission-line to the at least one electrical contact pair,
e) means for aligning and securing the at least one electrical transmission-line to the at least one electrical contact pair,
f) a housing protecting the at least one electrical contact pair and the substrate, and
g) means in the housing for communicating an electrical signal through the housing to the at least one electrical contact pair from the at least one electrical transmission-line.

Still another aspect of this invention discloses a method for providing an electrical transmission-line interface comprising:

a) securing at least one electrical contact pair in contact with at least one surface of a substrate,
b) securing at least one electrical transmission-line to the at least one electrical contact pair,
c) providing a housing to protect the at least one electrical contact pair and the substrate, and
d) providing means in the housing for communicating an electrical signal through the housing to the electrical contact pair from the at least one transmission-line.

Yet another aspect of this invention discloses a method for providing an electrical transmission-line interface comprising:

a) securing at least one electrical contact pair in contact with at least one surface of a substrate,
b) providing means for guiding at least one electrical transmission-line to the electrical contact pair,
c) providing means for aligning and securing the at least one electrical transmission-line to the at least one electrical contact pair,
d) providing a housing to protect the at least one electrical contact pair and the substrate, and
e) providing means in the housing for communicating an electrical signal through the housing to the at least one electrical pair from the at least one electrical transmission-line.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

The novel apparatus and method for the transmission-line interface of this invention is comprised of many aspects. The primary aspect of this invention is the utilization of substrate surface for electrical communication using a transmission-line, with little or no effect to other electronic devices that may be on the substrate.

Similarly, the invention also allows for the modification of the cooling configuration of a TCM with little or no impact to the cooling capabilities of the TCM. These and other unique features of this invention are discussed later in this section.

A transmission-line as used herein means, a coaxial cable or a twisted pair or a flat stripline, or any kind of line that will provide at least two electrical paths where the paths are electrically isolated from each other and there is a solid dielectric separating the electrical paths. Conventionally, these paths are referred to as the signal path and the ground path.

The transmission-line connection typically has a signal line as well as a ground line to form an electrical contact pair. The electrical contact pair could be on the surface of a substrate or could be formed in conjunction with an electrical connection means, such as a connector.

An electronic device as used herein could include passive circuit elements, such as resistors, capacitors, and inductors, or semiconductor devices, and associated circuitry, such as diodes, transistors, and logic circuits, to name a few.

Figure 1:
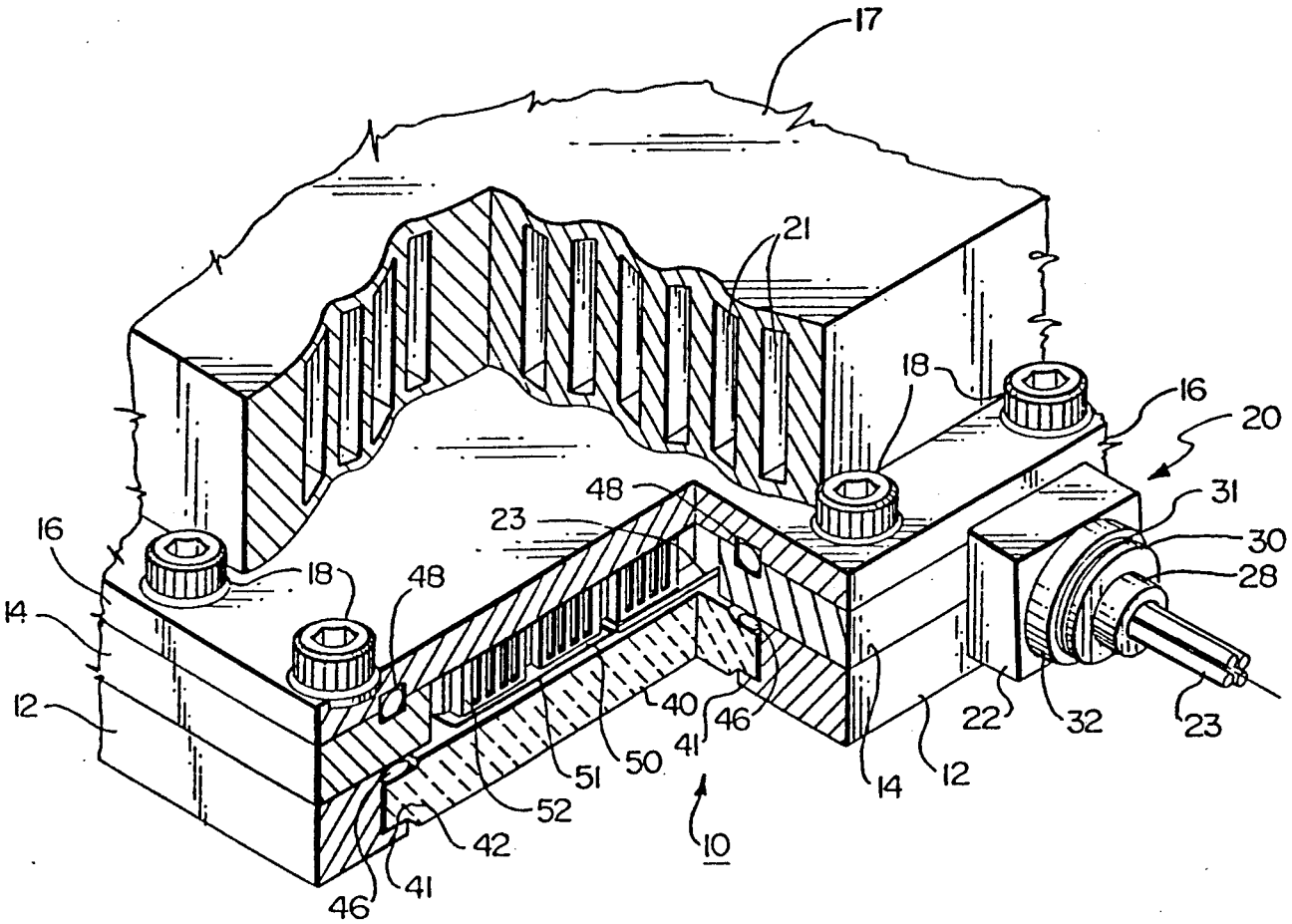
FIG. 1 is a cut-away perspective view of a coaxial cable mounting assembly of this invention interfacing with a TCM.

For the purposes of illustration only in FIG. 1, a Thermal Conduction Module or TCM 10, comprising a lower frame 12, an upper frame or hat 16, sandwiching a seal frame 14, which has been modified, is shown. Other types of modules could also be used with this invention, such as the Multichip Module (MCM) or air-cooled module, to name a few. The lower frame 12, seal frame 14, and upper frame 16, are held together by securing means, such as bolts 18. Usually a cold plate 17, having a number of coolant channels 21, is secured to the upper surface of the upper frame 16, by means well known in the art. A substrate 40, having stepped edge 42, and having semiconductor chips 50, thereon, is secured between the ledge 41, of the lower frame 12, and the extension of seal frame 14, with a gasket 46, therebetween. It is customary to have heat exchange elements 52, such as the High Conduction Cooling (HCC) elements as disclosed in U.S. patent Ser. No. 07/198,962 (Horvath, et al.) now U.S. Pat. No. 5,052,481, to transfer the heat generated by the chip 50, to the upper frame or hat 16. For the purposes of illustration only, the upper frame or hat 16, is discussed in conjunction with heat exchange element 52, or HCC element 52, but the upper frame could have any type of a cooling device or structure, for example, the upper frame 16, could be similar to the one as disclosed in U.S. Pat. No. 4,226,281, or the one disclosed in U.S. Pat. No. 4,235,283. Of course, in any situation the upper frame 16, would have to be modified to accommodate a guide or a retainer-like element, as discussed later in this section. A retainer 51, is normally used to hold the heat exchange elements 52, in place. As discussed later in this section, this retainer 51, is also used to provide the guide grooves and securing means for a transmission-line 23, such as a coaxial cable 23. For the purposes of illustration only the transmission-line 23, is being referred to as coaxial cable 23, but, this does not limit other forms of transmission-lines that can be used with this invention. In cooling devices or structures where there is no retainer 51, the cooling device or structure could be easily modified by a person skilled in the art to provide means for guiding and securing the coaxial cable 23, from the exterior of the TCM 10, to a site where the end of the coaxial cable 23, will be secured on the substrate 40. A fluid tight seal with respect to the interior of the module that includes the chips 50, that are on the substrate 40, HCC elements 52, and other related elements, may be achieved by means of gaskets 46 and 48. A coaxial cable mounting assembly 20, provides the interface between the coaxial cables 23, and the TCM 10. Face plate 22, keeper 32, wave washer 31, retainer 30, and shoulder 28, are various components of the coaxial cable mounting assembly 20, that normally protrude out of the TCM 10.

The coaxial cable mounting assembly 20, may be located between any adjacent pair of bolts 18, along the sides of the TCM 10. Therefore, any side of the TCM 10, may then accommodate (N−1) coaxial cable mounting assemblies 20, where N=number of bolts along the given side of the TCM 10. Each coaxial cable mounting assembly 20, has at least one coaxial cable 23. Each coaxial cable 23, typically has an electrical conductor in the center, with a low dielectric constant insulator of suitable thickness over the center conductor, and this sub-assembly is then encased within a tubular electrical conductor.

Figure 2:
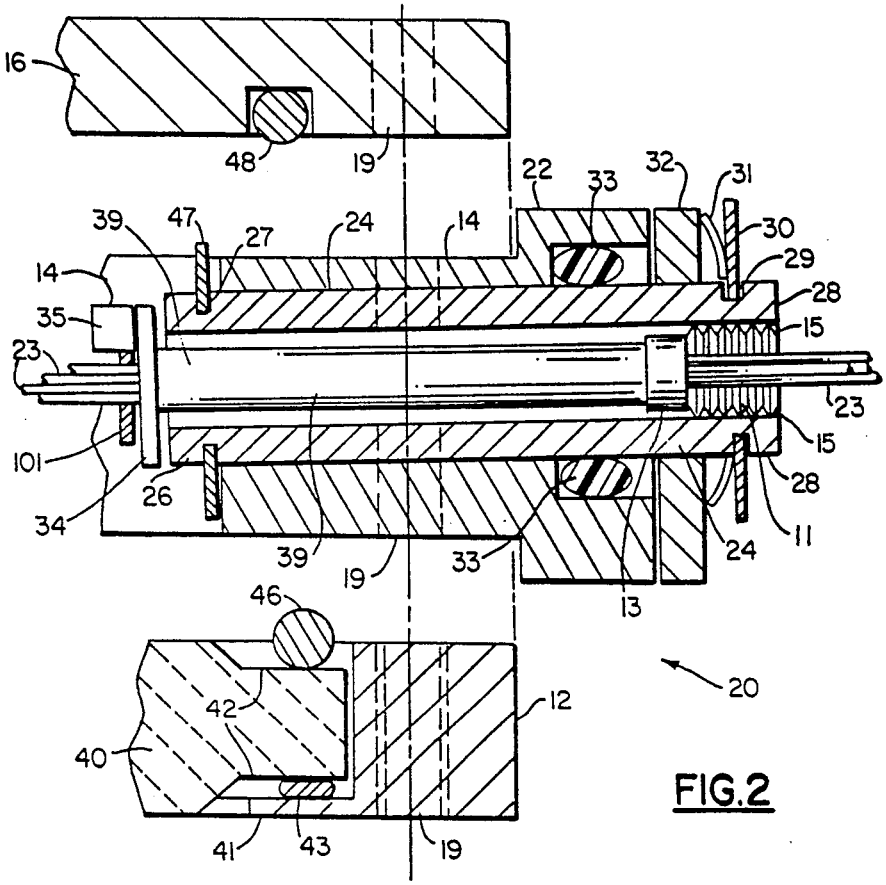
FIG. 2 is an enlarged cross-sectional view of the assembled interface between the coaxial cable mounting assembly and the TCM elements.

FIG. 2 illustrates a view of the elements of the coaxial cable mounting assembly 20, which provides penetration through the side of the seal frame 14. The seal frame 14, has a series of holes 19, to accommodate the bolts 18. A stress relief sleeve 24, has shoulders 26 and 28, at each end, and also radial grooves 27 and 29, to accommodate retaining rings 47 and 30, respectively. The coaxial cable mounting assembly 20, can be prepared by feeding the coaxial cables 23, through the opening in the stress relief sleeve 24.

FIG. 2 further shows an enlarged cross-sectional view of the assembled coaxial cable mounting assembly 20, as part of the seal frame 14, and the upper frame 16, and lower frame 12. The coaxial cables 23, are passed through a stress relief sleeve 24, so that a flanged tube 39, is welded peripherally to the bellows 11, at its shoulder 13. The other end of the bellows 11, is soldered to the lip 15, on the stress relief sleeve 24, to effect part of the seal system for the coaxial cable mounting assembly 20. The flanged tube 39, is extended a fixed distance from the face of the shoulder 26, and a spacer is temporarily inserted while the outer conductors of the coaxial cables 23, are soldered to the openings on the face of the flange 34. Removing the temporary spacer allows the coaxial cables 23, to move along the axis of the stress relief sleeve 24, by compressing the bellows 11, until the flange 34, seats on the face of the shoulder 26. Conversely, the flange 34, is free to displace away from the face of the shoulder 26, by extending bellows 11. The extension of the bellows 11, is limited by the tab 35, which is part of the bias spring 101, discussed later in FIG. 5. The constrained axial displacement of the bellows 11, compensates for the expansivity differential between the semi-rigid coaxial cables 23, and the TCM assembly 10.

This sub-assembly can now be fed through the hole in the seal frame 14, and the face plate 22. The retainer ring 47, is expanded and then relaxed into the groove 27. The stress relief sleeve 24, is now pulled away or back from the seal frame 14, and O-ring 33, keeper 32, wave washer 31 and retainer ring 30, are slid in place to fully secure the stress relief sleeve 24, to the seal frame 14. This is accomplished by relaxing the retainer ring 30, into the radial groove 29, which compresses and securely holds this assembly in place against the face plate 22. The retainer ring 47, inserted in the radial groove 27, at the other end of the stress relief sleeve 24, securely locks the stress relief sleeve 24, in place.

The lower frame 12, and the upper frame 16, are sealed with gaskets 46 and 48, respectively. The gasket 33, provides an effective seal for the coaxial cable mounting assembly 20. Gaskets 46 and 48, can be an "O-Ring" or a "C-Ring", type gasket to effect sealing when assembled to other elements of the TCM 10, using bolts 18. A pad 43, that is between the ledge 41, and stepped edge 42, provides a cushion for the substrate 40.

Figure 3:
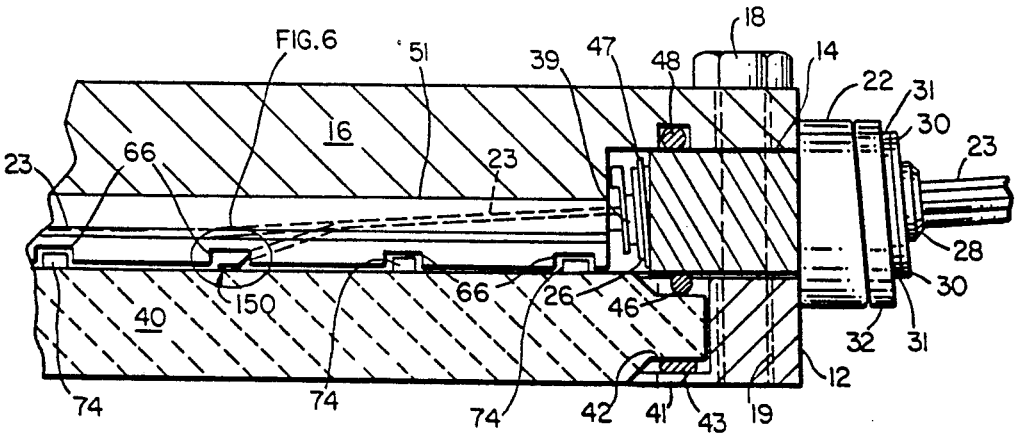
FIG. 3 is a partial cross-sectional view showing the passage of the coaxial cable through the coaxial cable mounting assembly to the coaxial cable connection site.

FIG. 3, illustrates a partial cross-sectional view showing the passage of the coaxial cable 23, through the coaxial cable mounting assembly 20, to the coaxial cable connection site 150. This coaxial cable connection site 150, can be placed practically at any location on the substrate 40. These locations could include the sites for semiconductor chip 50, or the sites for decoupling capacitor 74, or between chip edges, to name a few. The preferred location for the coaxial cable connection site 150, would be to replace a decoupling capacitor 74, and use that site for the coaxial cable connection. Because, by removing a few decoupling capacitors 74, there will be negligible loss in noise immunity, but the removal of a semiconductor chip 50, could have significant loss in circuit capacity. Additionally, the replacement of the decoupling capacitor 74, can be done with minimal design change of the substrate wiring. The introduction of these coaxial cables provides a significant increase in function and low noise communication means.

The thermal expansion differential of the various materials in the TCM will produce strain on the semi-rigid coaxial cable 23. This expansivity differential between the coaxial cable 23, and the TCM 10, can be accommodated by the bellows 11, which has contraction and expansion capability. The retainer 51, has openings 66, to accommodate either a coaxial cable connection, or a decoupling capacitor 74.

Figure 4A:
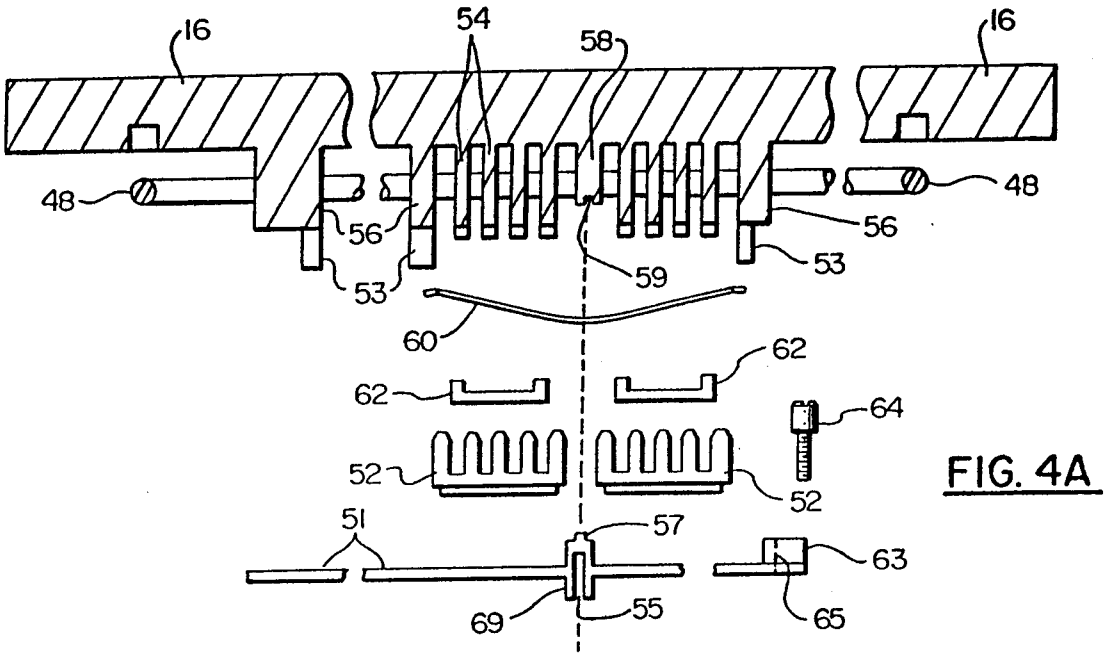
FIG. 4A is an exploded side view showing the retainer having a coaxial cable guide groove, and other related elements.

It was also discovered that the existing cooling configuration of part of the upper frame could be modified to allow containment, passage and alignment for the coaxial cable. This modification allows for maximum utilization of the cooling configuration without impacting the cooling performance. For the purposes of illustration only, the cooling configuration which is similar to the cooling configuration of U.S. patent Ser. No. 07/198,962, now U.S. Pat. No. 5,052,481 (Horvath, et al.) is shown in FIG. 4A, but any existing cooling configuration can be similarly adapted to be used with this invention.

In order to position the coaxial cables 23, within the available space in the TCM 10, a retainer 51, with guide channel 69, and the upper frame 16, are modified. These modifications are shown in FIG. 4A. The retainer seat 53, is modified to accommodate the retainer 51. The retainer 51, must also be modified to provide means for securely holding coaxial cable connection means, such as substrate connector. The upper frame 16, is also modified by shortening one of the retaining guides or large fins 56, to form a stub guide 58. The stub guide 58, has a restraining groove 59, or a key depending on which type of delay is employed. When spirally wound coaxial cable delay line 71, is used, the tapered slot 55, in FIG. 4A, and the coaxial cable guide 69, are inverted as shown and discussed in FIG. 4B. The periphery of the upper frame 16, has a groove to accommodate gasket 48. The fins 54, on the upper frame 16, mesh with the fins of the HCC element 52, as described in U.S. patent application Ser. No. 07/198,962, now U.S. Pat. No. 5,052,481 (Horvath, et al.). The retainer 51, is a standard retainer that is used in conjunction with the upper frame 16, but now has been modified to have at least one coaxial cable guide 69, having tapered channel 55, and key 57. The retainer 51, also has at least one boss 63, with openings 65, to accommodate an eccentric pin 64. A HCC spring 62, is normally inserted in the openings in the HCC element 52, and this sub-assembly is then placed in the openings in the upper frame 16. The retainer 51, and the retainer spring 60, are then securely attached to the upper frame 16, with the seal frame 14, securely holding this assembly in place. The retainer spring 60, has openings (not shown) to allow the passage of the upper surface of the coaxial cable guide 69, and the key 57, that mates with the restraining groove 59. The result of this modification is to provide a coaxial cable guide 69, and still effect the X, Y and Z-axis movement control for the heat exchange element or HCC element 52. The coaxial cable 23, is placed in the tapered retainer channel 55. The flat spring 60, that is placed between the retainer 51, and the upper frame 16, maintains engagement of the coaxial cable connector means, such as the substrate connector, during normal operation and preclude Z-axis motion and compensates for substrate 40, deflections due to module connector actuation.

Figure 4B:
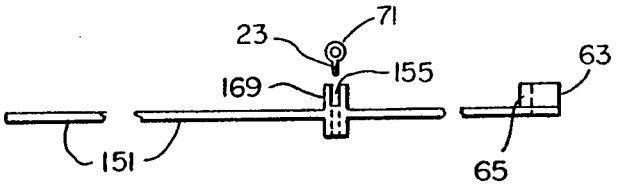
FIG. 4B shows a modified retainer with an inverted coaxial cable guide groove.

FIG. 4B shows modifications to accommodate spirally wound integral delay line 71. The transmission-line 23, is spirally wound so that at least a portion of the transmission-line 23, can be used to form a spirally wound delay line 71. Of course the transmission-line 23, could have one or more of these spirally wound delay lines 71. The retainer 151, is similar to the retainer 51, as discussed above, except that the tapered slot 55, is now an inverted tapered slot 155, that is used to securely accommodate the spirally wound integral delay line 71, within the coaxial cable guide channel 169. The delay line 71, is made by spirally winding a portion of the coaxial cable 23. The restraining groove 59, is replaced with a matching key (not shown) to accommodate the inverted tapered groove 155.

In some cases the transmission-line 23, may need to be electrically isolated from the electronic devices that are on the substrate, in such cases the retainer 51 or 151, could be electrically isolated from the substrate, by methods well known in the art, such as coating or anodization, to name a few. This electrical isolation could also be achieved by coating the naked transmission-line.

Figure 5:
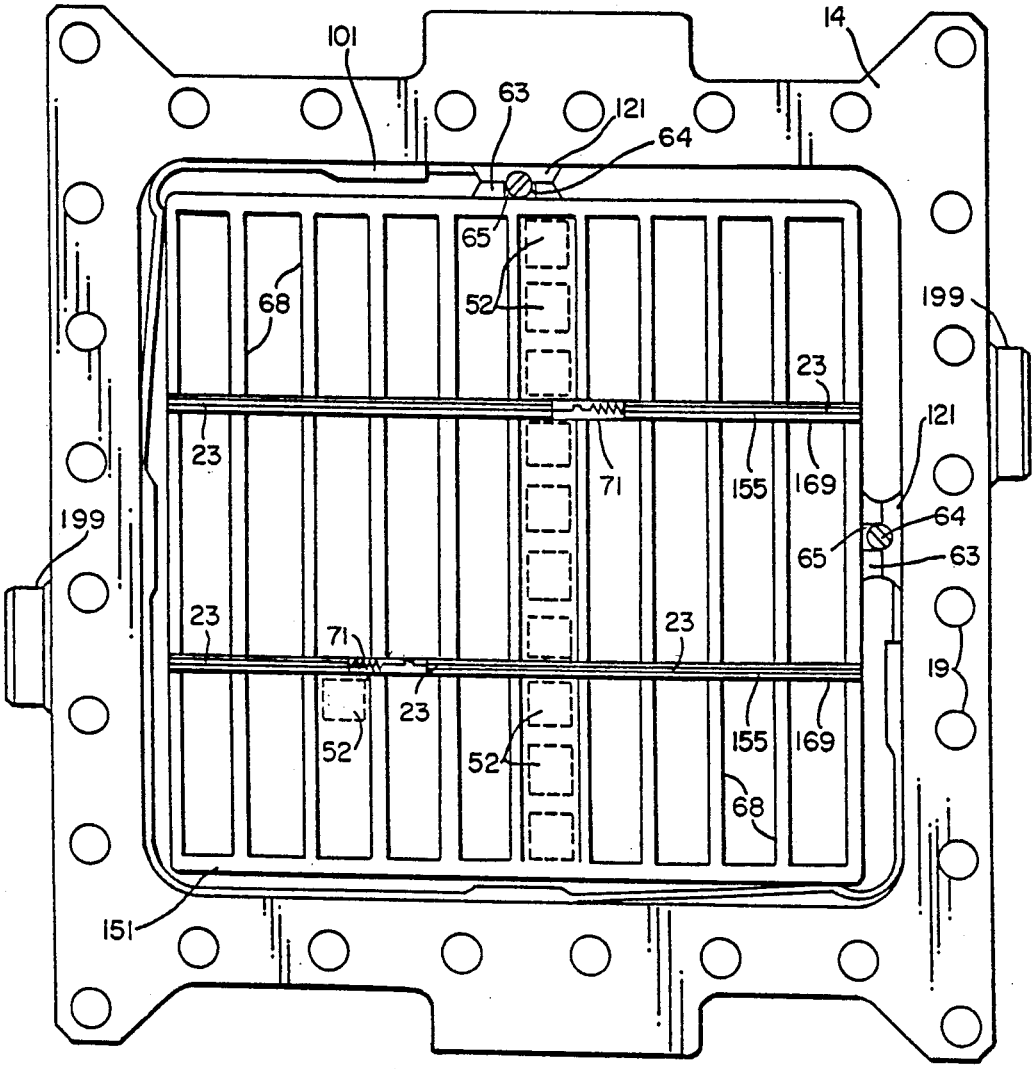
FIG. 5 illustrates a seal frame having the modified retainer of FIG. 4B, with alignment means.

The retainer 151, having sector rib 68, to position HCC element 52, is assembled through the top of the seal frame 14, by using two of its adjacent edges to compress a bias spring 101, located in the inside wall of the seal frame 14, as illustrated in FIG. 5. Corresponding bosses 121, to bosses 63, on adjacent edges of the retainer 151, are located on the inner sides of the seal frame 14. Bias spring 101, is located on the inner sides of the seal frame 14, to force the retainer 151, against eccentric pins 64, located on the bosses 121. The adjacent edges of retainer 151, are made to compress bias spring 101, so that opening 65, then engage eccentric pins 64. By rotating either of the eccentric pins 64, the retainer 151, can be precisely positioned in the X and Y axis. The substrate 40, can be laterally adjusted to optimize it for optimum pin/connector alignment and the eccentric pins 64, rotated to reduce side loading on the coaxial cables in guide groove 155. When the various components of the TCM 10, such as lower frame 12, seal frame 14, upper frame 16, coaxial cable mounting assembly 20, are assembled, care should be taken that these components provide a fluid tight seal, as the coaxial cable connector components and other electronic devices on substrate 40, must be protected from outside environmental elements. Also, in some cases, the TCM 10, may contain a fluidic medium that acts as the cooling or heat transfer medium for the various electrical components that are on the substrate 40. The stress relief sleeve 24, can also be modified to accommodate any number of coaxial cable connectors. One such connector is shown as coaxial cable connector 199. Use of such a coaxial cable connector 199, would make the TCM 10, modular or be plug-compatible.

Figure 6:
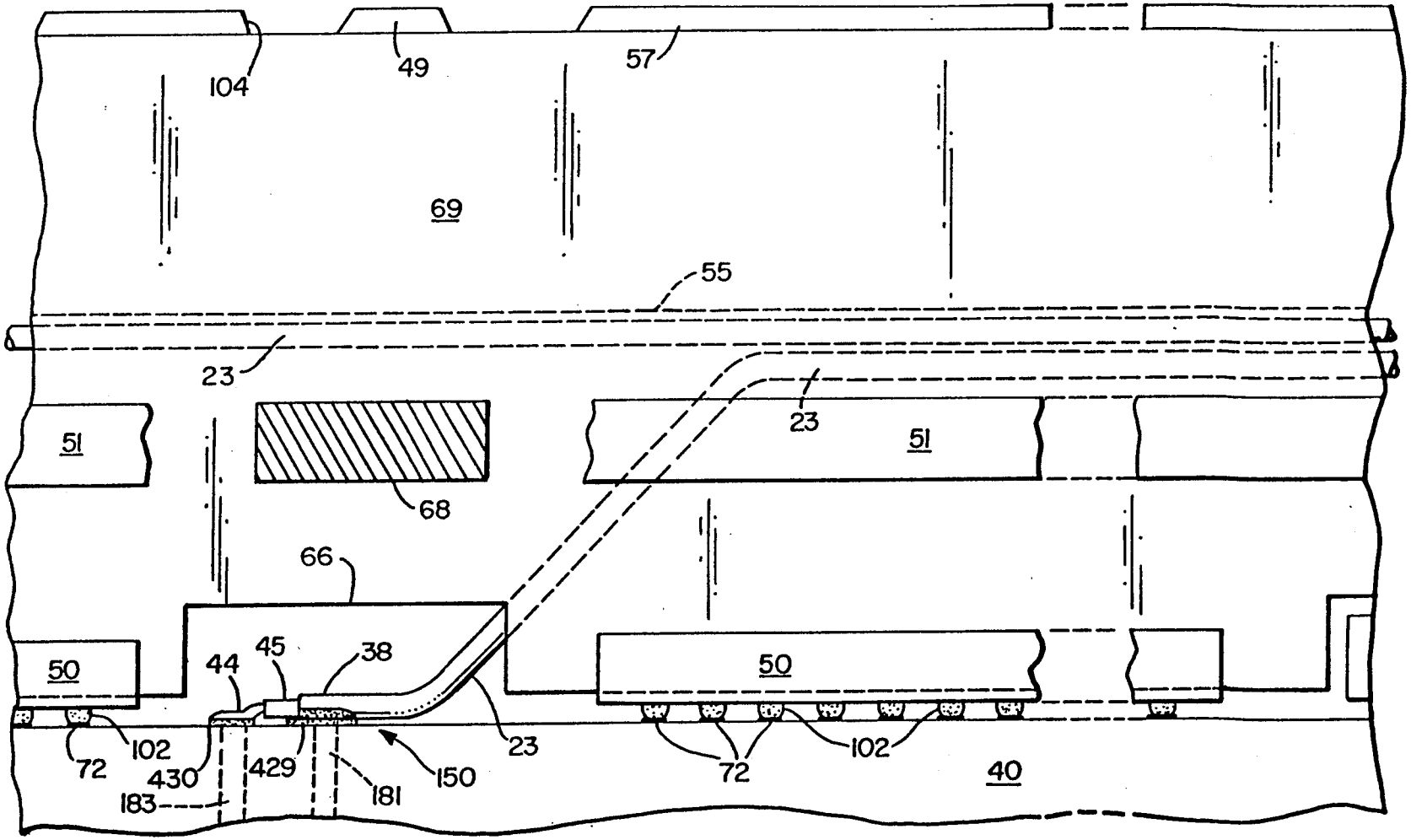
FIG. 6 is an enlarged view of the coaxial cable and connection means on a substrate with the partial guide elements.
Figure 9:
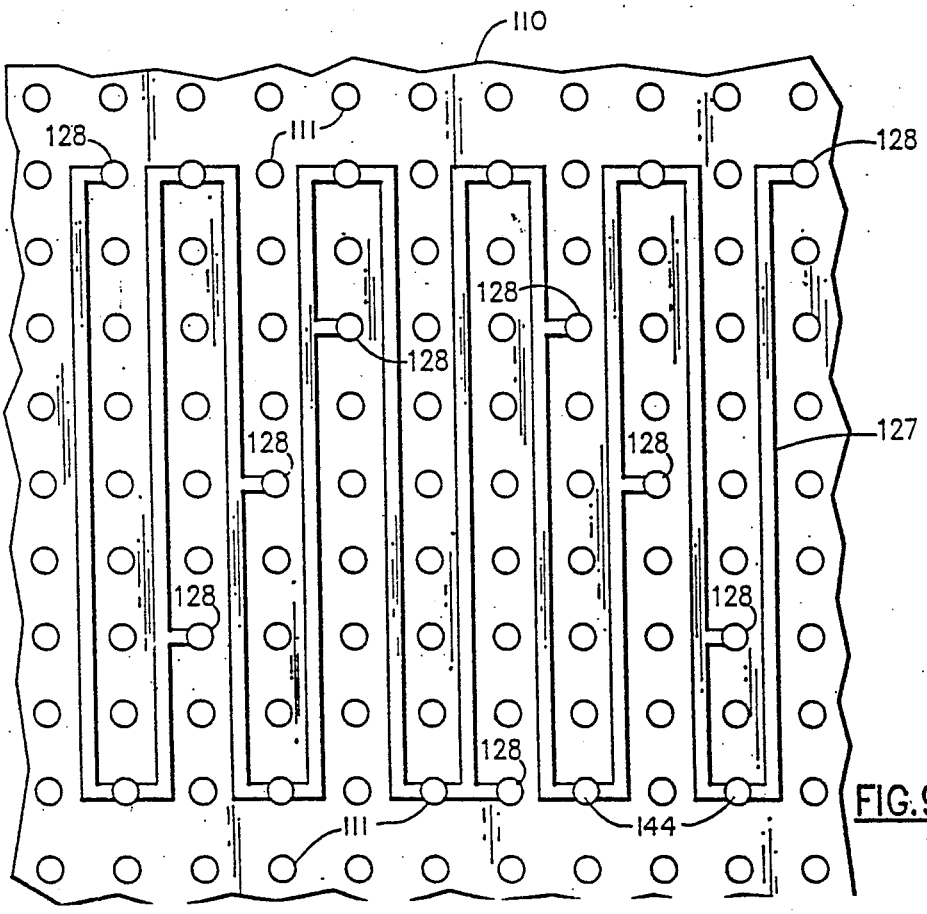
FIG. 9 is an example of a tapped delay line configuration within an MLC substrate.

FIG. 6 is an enlarged view of the coaxial cable connection site 150, and it also shows other related elements on the substrate 40. The substrate 40, can be a multilayered ceramic substrate 110, as shown in FIG. 9, or any other type of multilayered substrate. The substrate 40, of FIG. 6, has solder pads 429 and 430, for soldering the outer conductor 38, and the inner conductor 44, respectively, of the coaxial cable 23. Solder pads 72, are used to connect to solder balls 102, on a semiconductor chip 50, or to a decoupling capacitor 74 (not shown). The sector rib 68, is used to position the heat exchange elements 52 (not shown). The retainer 51, has a key 57, and a coaxial cable guide 69, that contains the tapered channel 55, as shown and discussed in FIG. 4A. The key 57, in some cases could have openings 104, to accommodate the flat retainer spring 60, using the interlock key 49.

The inner and outer conductors 44 and 38, insulated by an insulated jacket 45, are reflow-bonded on to the substrate 40 or 110, as, for example, at the vacated corner capacitor 74, position. Electrical wiring to the appropriate chips 50, through the vias 181 and 183, provides the electrical circuit, that is needed to accommodate the various electrical features of this invention, such as the master clocking circuitry or connection to the integral delay line.

The substrate 40, or the multilayered substrate 110, typically has pins on the underside, which are electrically connected to metal layers by means of metal filled vias 181 and 183. This electrical path provides electrical connection to external circuitry and power distribution.

Figure 7:
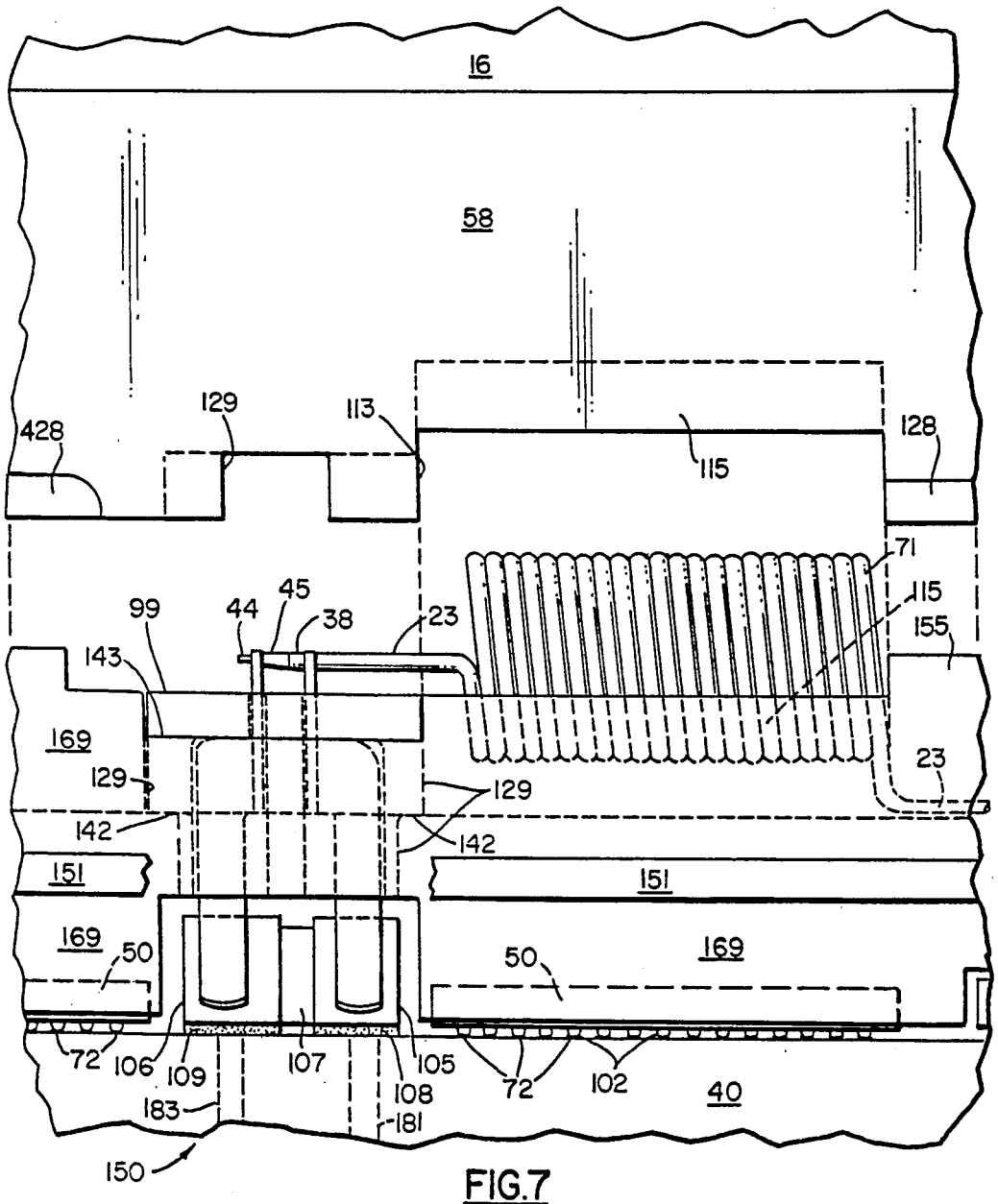
FIG. 7 is an enlarged view of another embodiment of the coaxial cable with a coiled delay line and connection means on a substrate with the partial guide elements.

FIG. 7, shows a view of a preferred alternative embodiment of a separable connection means for securing the coaxial cable 23, to the substrate 40 or 110. The connector means is preferably positioned along the axis of the coaxial cable guide 169, and between any pair of bolts 18, as discussed earlier.

FIG. 7 also illustrates the spirally wound delay line 71, configured to be integral with the miniature semi-rigid coaxial cable 23. The delay line 71, requires that the tapered guide channel 155, be relocated to the top of the guide channel 169. This relocation precludes electrical contact of the outer conductor 38, of the coiled delay line 71, to the pads (not shown) that are disposed on the surface of the substrate 40 or 110, and which are located between edges of adjacent semiconductor chips 50. To accommodate expansion differential between the coiled delay line 71, the number of coils will be limited to at least two less than the number of coils possible within the cylindrical seat 115, located in the tapered wall channel 155, and the stub fin 58. Located in the guide member 169, is a connector cavity 129, for securing the connector assembly 99.

The stub guide 58, which is part of the upper frame 16, is made to engage guide member 169, with keys 428, interlocked with tapered wall channel 155, to align the stub guide 58, and the guide member 169. Further, the triple protrusion 113, engage the top face of connector assembly 99, to lock it in place.

The slotted T-shaped contacts 105 and 106, are bonded to the solder pads 108 and 109, respectively, with the insulator 107, separating the contacts 105 and 106. The assembly of upper frame 16, seal frame 14, lower frame 12, and related gaskets 46 and 48, results in contacts 203 and 103, as shown and discussed in FIG. 8A, mating with slotted T-shape contacts 105 and 106, respectively. The separable connector assembly 99, provides the electrical path between the coaxial cable 23, and circuit chip 50, through wiring in the substrate 40 or 110.

Figure 8A:
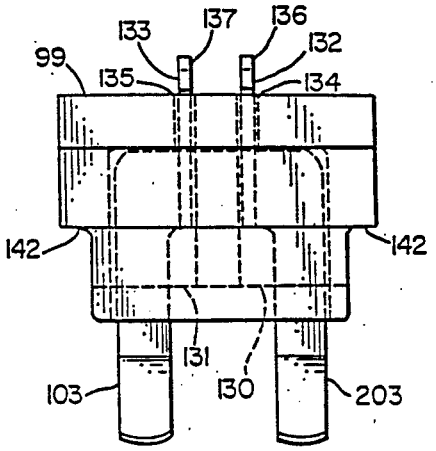
FIG. 8A is a side view of a modified connector which is used for connecting the coaxial cable to the MLC substrate.
Figure 8B:
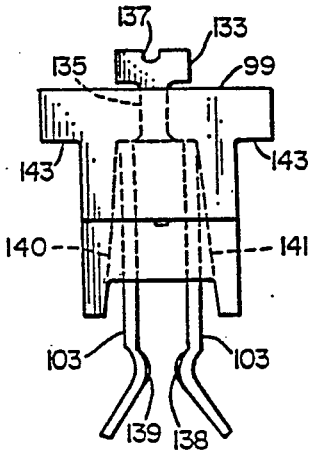
FIG. 8B is an end view of the modified connector of FIG. 8A.

The connector assembly 99, is shown in front and side views in FIG. 8A and 8B, respectively. The connector assembly 99, could be similar to the universal electrical connector, as disclosed in U.S. Pat. No. 3,915,537 (Harris et al.), the disclosure of which is incorporated herein by reference. The connector assembly 99, has a pair of back-to-back oriented spring contacts 203 and 103. The contacts are assembled in individual cavities 130 and 131, so as to be electrically isolated from each another. Tabs 132 and 133, are curved to pass through matching curved slots 134 and 135, on the top face of the connector assembly 99. After insertion of the curved tabs 132 and 133, through the matching curved slots 134 and 135, tabs 132 and 133, are flattened which captivates contacts 203 and 103, to the connector assembly 99. Tabs 132 and 133, have slots 136 and 137, respectively, to accept the center conductor 44, and outer conductor 38, of the coaxial cable 23. The modified contacts 203 and 103, are normally used for connection to pins (not shown), located at the bottom of substrate 40 or 110. Contacts 203 and 103, are double cantilever beams that engage flat contact element of suitable thickness between contact locations 138 and 139. The contact cavities 131 and 130, have angled side walls 140 and 141, respectively, to accommodate movement of the double cantilever beams 203 and 103. The upper shoulders 143, the lower shoulders 142, on the connector assembly 99, are configured to match similar ledges on the connector cavity 129, as shown in FIG. 7. With the connector assembly 99, seated in the connector cavity 129, the outer conductor 38, and the inner conductor 44 are soldered in slots 136 and 137, respectively, of contacts 203 and 103.

FIG. 9 illustrates an example of a printed wiring pattern that is embedded in the wiring planes of an MLC substrate 110. Electrically conductive line 127, is formed into a serpentine pattern, as shown. The MLC substrate 110, is configured with equally spaced vias 111. In order to form the tapped delay line the vias 111, are being tapped at various intervals to form via taps 128. The vias 144, are similar to vias 111, except that vias 144, can be tapped to form via taps 128. This subdivision of the original taps allows one to further fine tune the delay in the electrically conductive lines 127, by these incremental changes. The serpentine pattern of the electrically conductive line 127, is the preferred pattern for the tapped delay line, but other two-dimensional or three-dimensional pattern configurations across the multilayered substrate in a multi-planar configuration can be made by a person skilled in the art. The tapped delay line is used when a variety of values are desired. Tapped delay lines can be combined with integral coaxial delay elements to tune or obtain variable delays.

As discussed earlier, the coaxial cable 23, can be used for communication for clock distribution and data-bus applications. Typically an electronic clock distribution system is comprised of a master oscillator from which a clock pulse train is distributed to satellite electronic functions, such as a logic chip on a substrate contained in a TCM. This invention enables the distribution of clock pulse trains through optimum transmission lines such as coaxial cables in conventional TCM. This coaxial cable distribution system relative to present-day microstrip and tri-plate transmission systems allows for:

a) reduced skew, i.e., clock pulse arrival time variation,
b) lower noise at high clock frequencies (greater than 100 megahertz),
c) increased distance between electrical functions due to less waveform distortion and coupled-noise,
d) elimination of speed-matching buffers, and,
e) optimization of impedance-matching terminations.

If an optical clock were to be utilized such as the one in this invention, a practical implementation would entail the distribution of a clock pulse train to each quadrant of the MLC substrate. Further clock distribution by the electrical nets within each quadrant then synchronizes the logical operations to a machine cycle-time for the computer chips.

In the data bus application, high-speed bits of data must be communicated between memory locations or between data storage and logic chips. This invention enables the use of coaxial cables to interconnect chips in tight bundles of coaxial cables with significantly lower coupled-noise than current printed circuit wiring.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An apparatus for an electrical transmission-line interface comprising:

a) a substrate,
b) at least one electrical contact pair in direct electrical contact with at least one electrical component on at least one surface of said substrate,
c) at least a portion of at least one transmission-line electrically communicating with said at least one electrical contact pair,
d) a housing protecting said at least one electrical contact pair and said substrate,
e) means in said housing for communicating an electrical signal through said housing to said electrical contact pair via said at least one transmission-line, and
f) wherein at least a portion of said transmission-line inside said housing is attached to a bellows to provide strain relief to said transmission-line, while at least a portion of said bellows is secured to at least a portion of said housing.

2. The apparatus of claim 1, wherein said substrate is a multilayered ceramic substrate.

3. The apparatus of claim 1, wherein said electrical contact pair comprises at least one signal line and at least one ground line, and wherein each of said signal lines and said ground lines are isolated from each other by a solid dielectric.

4. The apparatus of claim 1, wherein said means for communicating an electrical signal through said housing comprises at least one connector.

5. The apparatus of claim 1, wherein said means for communicating an electrical signal through said housing comprises at least one transmission-line mounting assembly.

6. The apparatus of claim 1, wherein said housing has means for providing a fluid tight seal.

7. The apparatus of claim 1, wherein said housing further comprises means for heat transfer.

8. The apparatus of claim 1, wherein said housing further comprises fluidic means for heat transfer.

9. The apparatus of claim 1, wherein said housing has a retainer, and wherein said retainer has means for securely accommodating at least one transmission-line.

10. The apparatus of claim 1, wherein said housing has a retainer, and wherein said retainer has means for securely holding at least a portion of at least one substrate connector.

11. The apparatus of claim 1, wherein said housing has a retainer, and wherein said retainer is electrically isolated from said substrate.

12. The apparatus of claim 1, wherein said electrical transmission-line is selected from a group comprising, coaxial cable, flat cable and twisted pair line.

13. A method for providing an electrical transmission-line interface comprising:

a) securing at least one electrical contact pair in direct electrical contact with at least one electrical component on at least one surface of a substrate,
b) securing at least one electrical transmission-line to said at least one electrical contact pair,
c) providing a housing to protect said at least one electrical contact pair and said substrate,
d) providing means in said housing for communicating an electrical signal through said housing to said electrical contact pair via said at least one transmission-line, and
e) wherein at least a portion of said transmission-line inside said housing is attached to a bellows to provide strain relief to said transmission-line, while at least a portion of said bellows is secured to at least a portion of said housing.

14. The method of claim 13, wherein said substrate is multilayered ceramic substrate.

15. The method of claim 13, wherein said electrical contact pair comprises at least one signal line and at least one ground line, and wherein each of said signal lines and said ground lines are isolated from each other by a solid dielectric.

16. The method of claim 13, wherein said means for communicating an electrical signal through said housing comprises at least one connector.

17. The method of claim 13, wherein said means for communicating an electrical signal through said housing comprises at least one transmission-line mounting assembly.

18. The method of claim 13, wherein said housing has means for providing a fluid tight seal.

19. The method of claim 13, wherein said housing further comprises means for heat transfer.

20. The method of claim 13, wherein said housing further comprises fluidic means for heat transfer.

21. The method of claim 13, wherein said housing has a retainer, and wherein said retainer has means for securely accommodating at least one transmission-line.

22. The method of claim 13, wherein said housing has a retainer, and wherein said retainer has means for securely holding at least a portion of at least one substrate connector.

23. The method of claim 13, wherein said housing has a retainer, and wherein said retainer is electrically isolated from said substrate.

24. The method of claim 13, wherein said electrical transmission-line is selected from a group comprising, coaxial cable, flat cable and twisted pair line.

25. A method for providing an electrical transmission-line interface comprising:

a) securing at least one electrical contact pair in direct electrical contact with at least one electrical component on at least one surface of a substrate, b) providing means for guiding at least one electrical transmission-line to said electrical contact pair, c) providing means for aligning and securing said at least one electrical transmission-line to said at least one electrical contact pair, d) providing a housing to protect said at least one electrical contact pair and said substrate, e) providing means in said housing for communicating an electrical signal through said housing to said at least one electrical pair by means of said at least one electrical transmission-line, and f) wherein at least a portion of said transmission-line inside said housing is attached to a bellows to provide strain relief to said transmission-line, while at least a portion of said bellows is secured to at least a portion of said housing.

26. The method of claim 25, wherein said substrate is a multilayered ceramic substrate.

27. The method of claim 25, wherein said electrical contact pair comprises at least one signal line and at least one ground line, and wherein each of said signal lines and said ground lines are isolated from each other by a solid dielectric.

28. The method of claim 25, wherein said substrate has at least one means for fixed and variable time-delay.

29. The method of claim 25, wherein said transmission-line has means for time-delay.

30. The method of claim 25, wherein at least a portion of said transmission-line is spirally wound to form at least one spirally wound integral delay line.

31. The method of claim 25, wherein said means for communicating an electrical signal through said housing comprises at least one connector.

32. The method of claim 25, wherein said means for communicating an electrical signal through said housing comprises at least one transmission-line mounting assembly.

33. The method of claim 25, wherein said housing has means for providing a fluid tight seal.

34. The method of claim 25, wherein said housing further comprises means for heat transfer.

35. The method of claim 25, wherein said housing further comprises fluidic means for heat transfer.

36. The method of claim 25, wherein said housing has a retainer, and wherein said retainer has means for securely accommodating at least one transmission-line.

37. The method of claim 25, wherein said housing has a retainer, and wherein said retainer has means for securely holding at least a portion of at least one substrate connector.

38. The method of claim 25, wherein said housing has a retainer, and wherein said retainer is electrically isolated from said substrate.

39. The method of claim 25, wherein said electrical transmission-line is selected from a group comprising, coaxial cable, flat cable and twisted pair line.

40. An apparatus for an electrical transmission-line interface comprising:

a) a substrate, b) at least one electrical contact pair in direct electrical contact with at least one electrical component on at least one surface of said substrate, c) at least one electrical transmission-line, d) means for guiding said at least one electrical transmission-line to said at least one electrical contact pair, e) means for aligning and securing said at least one electrical transmission-line to said at least one electrical contact pair, f) a housing protecting said at least one electrical contact pair and said substrate, g) means in said housing for communicating an electrical signal through said housing to said at least one electrical contact pair by means of said at least one electrical transmission-line, and h) wherein at least a portion of said transmission-line inside said housing is attached to a bellows to provide strain relief to said transmission-line, while at least a portion of said bellows is secured to at least a portion of said housing.

41. The apparatus of claim 40, wherein said substrate is a multilayered ceramic substrate.

42. The apparatus of claim 40, wherein said electrical contact pair comprises at least one signal line and at least one ground line, and wherein each of said signal lines and said ground lines are isolated from each other by a solid dielectric.

43. The apparatus of claim 40, wherein said substrate has at least one means for fixed and variable time-delay.

44. The apparatus of claim 40, wherein said transmission-line has means for time-delay.

45. The apparatus of claim 40, wherein at least a portion of said transmission-line is spirally wound to form at least one spirally wound integral delay line.

46. The apparatus of claim 40, wherein said means for communicating an electrical signal through said housing comprises at least one connector.

47. The apparatus of claim 40, wherein said means for communicating an electric signal through said housing comprises at least one transmission-line mounting assembly.

48. The apparatus of claim 40, wherein said housing has means for providing a fluid tight seal.

49. The apparatus of claim 40, wherein said housing further comprises means for heat transfer.

50. The apparatus of claim 40, wherein said housing further comprises fluidic means for heat transfer.

51. The apparatus of claim 40, wherein said housing has a retainer, and wherein said retainer has means for securely accommodating at least one transmission-line.

52. The apparatus of claim 40, wherein said housing has a retainer, and wherein said retainer has means for securely holding at least a portion of at least one substrate connector.

53. The apparatus of claim 40, wherein said housing has a retainer, and wherein said retainer is electrically isolated from said substrate.

54. The apparatus of claim 40, wherein said electrical transmission-line is selected from a group comprising, coaxial cable, flat cable and twisted pair line.

* * * * *